United States Patent [19]

Osawa

[11] Patent Number: 4,765,111

[45] Date of Patent: Aug. 23, 1988

[54] ASSEMBLY FOR MOUNTING PLATES ON WALL

[76] Inventor: Yoshinori Osawa, 178, Oaza Sagami, Koka-cho, Koka-gun, Shiga, Japan

[21] Appl. No.: 100,345

[22] Filed: Sep. 23, 1987

[30] Foreign Application Priority Data

Jun. 18, 1987 [JP] Japan ..... 62-94026[U]

[51] Int. Cl.[4] ..... E04B 1/38

[52] U.S. Cl. ..... 52/509; 52/506; 52/235; 52/489

[58] Field of Search ..... 52/506, 474, 479, 481, 52/486, 762, 508, 509, 512, 489, 235

[56] References Cited

U.S. PATENT DOCUMENTS

| | | | |
|---|---|---|---|
| 1,052,670 | 2/1913 | Francis | 52/509 |
| 3,234,702 | 2/1966 | Zibell | 52/506 X |
| 3,300,934 | 1/1967 | Waizenhofer | 52/489 X |
| 3,357,144 | 12/1967 | Chauveau et al. | 52/235 X |
| 3,394,519 | 7/1968 | Tischuk | 52/489 X |
| 3,815,309 | 6/1974 | Olsen | 52/235 X |
| 4,607,471 | 8/1986 | Olsen | 52/509 |

FOREIGN PATENT DOCUMENTS

| | | | |
|---|---|---|---|
| 2577256 | 8/1986 | France | 52/509 |
| 366952 | 3/1963 | Switzerland | 52/486 |

*Primary Examiner*—Carl D. Friedman
*Assistant Examiner*—Creighton Smith
*Attorney, Agent, or Firm*—Wenderoth, Lind & Ponack

[57] ABSTRACT

An assembly for mounting plate-like materials on a wall surface. Horizontal bars are directly or indirectly mounted on the wall surface one above the other with spacings left therebetween. Two kinds of supports, one having a downward flange and the other having an upward flange, are mounted on the bar to support the plates with the downward and upward flanges engaging the top and bottom edges of the plate members, respectively.

2 Claims, 2 Drawing Sheets

ASSEMBLY FOR MOUNTING PLATES ON WALL

BACKGROUND OF THE INVENTION

The present invention relates to an assembly for mounting plates of marble, ceramic or similar materials on a wall.

It has been a common practice to attach such plates to the wall by applying mortar to the back of plates and pressing the plates against the wall. The conventional method requires highly skilled hands in obtaining uniformity in the width of joint or in making even the surface of the plates.

The more the vertical number of plates attached to the wall, the more the lower plates are liable to peel off the wall under the weight of upper plates, causing all the plates to fall off the wall. This limits the vertical number of plates which can be mounted on the wall.

In order to solve these problems, the applicant proposed a fitting assembly comprising a plurality of horizontal joiners arranged on the wall one above another at predetermined spacings (Japanese Examined Utility Model Publication No. 54-7631). In the prior art assembly, the plate is firstly lifted to fit the downwardly extending flange of the upper joiner in the groove formed in the top of the plate. Then the plate is lowered to fit the upwardly extending flange of the lower joiner in the groove formed in the bottom of the plate. If the plate is large in size and heavy, it is difficult to fit smoothly in the top groove. In addition to those who lift the plate (a large plate has to be lifted by two persons), an extra one is needed to fit in the grooves. Another problem is that the grooves formed in the top and bottom of each plate have to be relatively wide to allow fitting in the grooves. This is difficult for thin plates.

SUMMARY OF THE INVENTION

An object of the present invention is to provide an improved assembly for mounting plates which obviates the abovesaid shortcomings.

In the first embodiment, inverted U-shaped members are employed as the bar members. Two kinds of supports are fitted on the inverted U-shaped members from above.

In the second embodiment, bar members having their front lower portion bent forward are used, which function to reinforce the support and prevent their front part from being bent down under the weight of the plate even if they are made of marble or granite and thus heavy and large in size.

Other features and objects of the present invention will become apparent from the following description taken with reference to the accompanying drawings, in which:

<First Embodiment>

Figure 1:
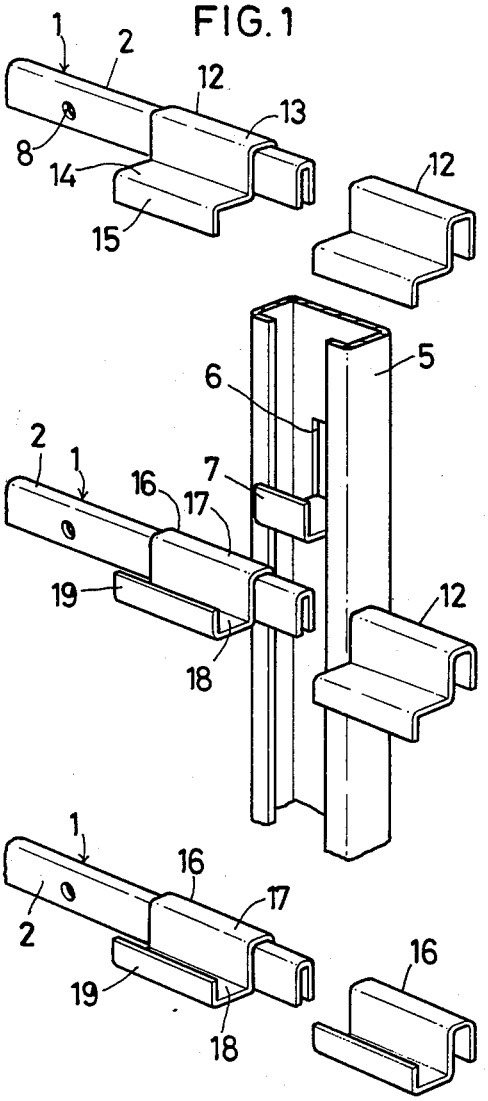
FIG. 1 is an exploded perspective view of the first embodiment.
Figure 2:
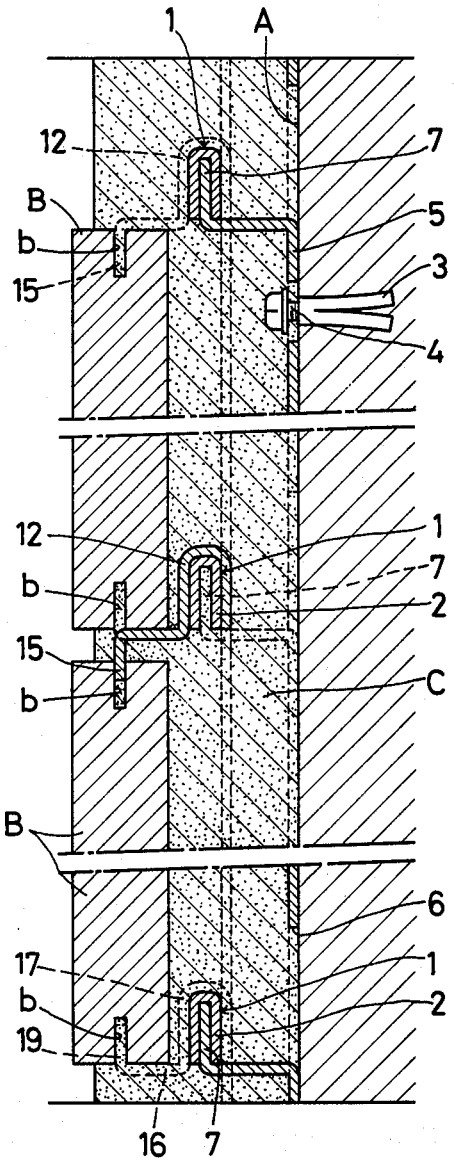
FIG. 2 is a vertical sectional side view showing how the plates are to the work surface.
Figure 3:
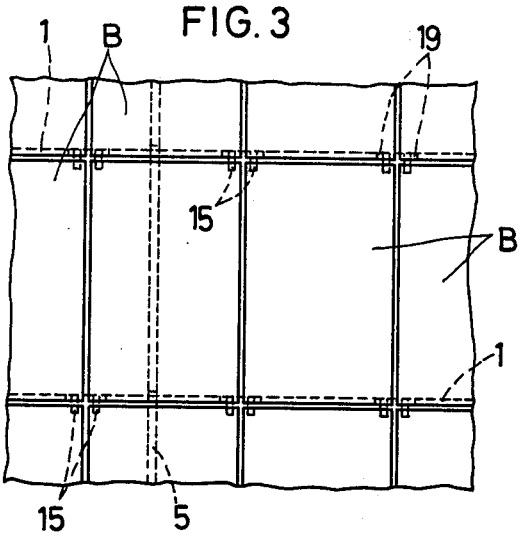
FIG. 3 is a front view of the same.

Referring to FIGS. 1 to 4, numeral 1 designates a bar member adapted to be horizontally mounted to a work surface A leaving some space at its back.

In order to mount the bar member 1 in the form of an inverted U-shaped plate 2, a plurality of vertical channels 5 are fixed to the work surface A by means of bolts 4 and anchors 3. The channels 5 are formed with U-shaped hooks 7 by forming a U shaped slit 6 in the channel 5 and striking it out forwardly. The plates 2 are mounted on the hooks 7 of the channels 5.

Figure 4:
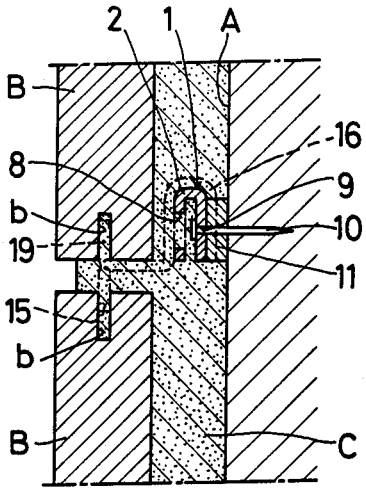
FIG. 4 is a vertical sectional side view showing a different manner of mounting the bar member.

As shown in FIG. 4, the bar members 1 may be secured by driving nails 10 into the work surface A through larger diameter holes 8 formed in the front portion of the bar 1 and through smaller diameter holes in its rear portion. In this case, a washer 11 is fitted on each nail 10 to leave some space between the bar 1 and the work surface A.

Numeral 12 designates a first support which comprises an inverted U-shaped portion 13 adapted to be fitted on the bar member 1 from above, a web 14 horizontally extending forwardly from the portion 13 and an engaging flange 15 extending downwardly from the web 14.

Numeral 16 designates a second support which comprises an inverted U-shaped portion 17 adapted to be fitted on the bar member 1 from above, a web 18 horizontally extending forwardly from the portion 17 and an engaging flange 19 extending upwardly from the web 18.

The first support 12 and the second support 16 may be made either by bending a metal plate as in the preferred embodiment or by cutting a profile.

It will be described below how the plate B is mounted. The second supports 16 are fitted with their inverted U-shaped portion 17 on the lowermost bar member 1 mounted on the vertical channel 5. The plates B are then fitted on the second supports 16 with their engaging flanges 19 in the grooves b in the bottom of the plates B. The webs 18 of the second supports 16 bear its weight.

The first supports 12 are fitted with their inverted-U portion 13 on the next to lowermost bar member 1 while inserting their engaging flange 15 into the groove b formed in the top of the plate B. The first supports 12 may be slid to bring their engaging flange 15 into engagement with the groove b.

The plates B are thus piled up one upon another in such a manner. Mortar C is filled into the back as well as between the opposite edges of the plates B. The grooves b and b' may be formed continuously over the entire width of each plate B or may be formed partially.

<Second Embodiment>

Figure 6:
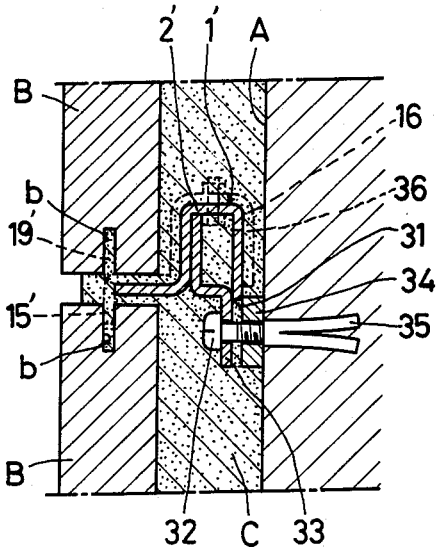
FIG. 6 is a vertical sectional view of the same.
Figure 5:
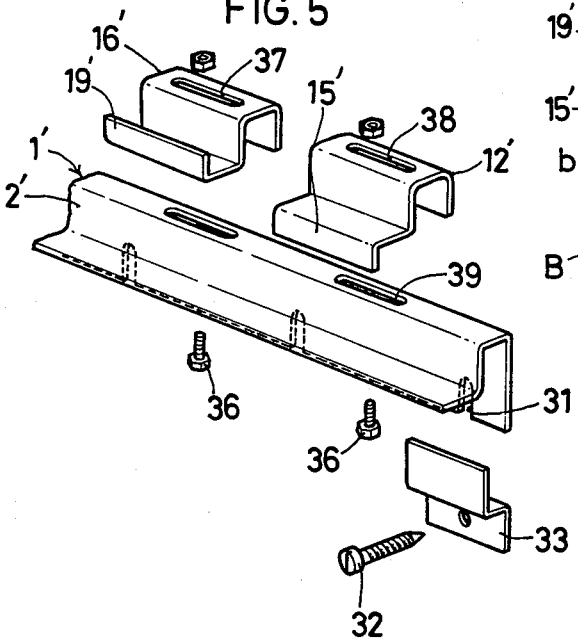
FIG. 5 is an exploded perspective view of the second embodiment.

Referring to FIGS. 5 and 6, bar members 1' are mounted on the work surface A horizontally at spacings substantially equal to the height of the plate B. The bar member 1' has its front plate at the lower half portion thereof bent forwardly to prevent the front part of the support fitted on the bar members from yielding under the weight of the plates B. The bar members 1' are formed in their back plate at the lower end with a plurality of cutouts 31.

The plates B are attached to the work surface as follows: Bolts 32 each fitted with washers 33 and 34 for supporting the bar member 1' are screwed halfway into anchors 35 formed in the work surface at predetermined locations. After the bar member 1' has been fitted with its cutouts 31 between the washers 33 and 34, the bolts 32 are tightened. Next, the second supports 16' having an upward engaging plate 19' are fitted on the lowermost bar member 1 and the plate B is set on the second support with the engaging plate 19' in the groove b in the bottom edge of the plate. Then, the first support 12' having a downward engaging plate 15' are fitted on the next to lowermost bar member 1', while inserting their engaging plate 15' into the groove b in the top of the plates B. Further the second supports 16' are fitted on the bar member 1' alternately with the first supports 12' so as to put its engaging plate into engagement with the groove b in the bottom of the plate B. The plates B are thus piled up one upon another in the same way.

The first and second supports and the bar members 1' may be formed in their top with slits 37, 38 and 39, respectively, so that the first support 12' and the bar member 1', and the second bearer 16' and the bar member 1' can be joined together by metal fittings 36.

What is claimed is:

1. An assembly for mounting a plurality of plates on a wall surface, comprising:

a plurality of bar members of a substantially inverted U-shape section and secured to the wall surface with some space left between the back of said each bar member and the wall surface;

a first support means comprising an inverted U-shaped portion adapted to be mounted on said bar member, a horizontal web portion for supporting the plate, and a flange portion downwardly extending from the front edge of said web portion so as to engage the upper edge of the plate; and a second support means comprising an inverted U-shaped portion adapted to be mounted on said bar member, a horizontal web portion for supporting the plate, and a flange portion upwardly extending from the front edge of said web portion so as to engage the bottom edge of the plate.

2. An assembly as claimed in claim 1, further comprising a plurality of channel members adapted to be secured to the wall surface at spacings therebetween and formed with a plurality of hooks vertically spaced from each other to support said bar members.

* * * * *